US007374207B2

(12) United States Patent
McCoy

(10) Patent No.: US 7,374,207 B2
(45) Date of Patent: May 20, 2008

(54) EDGE PROTECTING DEVICE FOR SNOWBOARDS AND THE LIKE

(76) Inventor: Frederick J. McCoy, 653 Lisbon Ave., Buffalo, NY (US) 14215

( * ) Notice: Subject to any disclaimer, the term of this patent is extended or adjusted under 35 U.S.C. 154(b) by 0 days.

(21) Appl. No.: 10/424,695

(22) Filed: Apr. 28, 2003

(65) Prior Publication Data

US 2003/0201636 A1 Oct. 30, 2003

Related U.S. Application Data

(60) Provisional application No. 60/375,985, filed on Apr. 26, 2002.

(51) Int. Cl.
*A63C 11/02* (2006.01)

(52) U.S. Cl. ..... 280/815; 280/809

(58) Field of Classification Search ..... 280/809, 280/814, 815, 608, 609, 610, 14; 206/315.1, 206/523; 150/154

See application file for complete search history.

(56) References Cited

U.S. PATENT DOCUMENTS 1,925,697 A * 9/1933 Johnson ..... 280/825
2,118,875 A * 5/1938 Windheim ..... 224/609
2,180,686 A * 11/1939 Lorinovich ..... 280/815
3,355,183 A 11/1967 Kneissl
3,374,495 A 3/1968 Joyce
3,424,469 A 1/1969 Hooker
3,481,619 A * 12/1969 Powers ..... 280/18
4,006,912 A 2/1977 Perlich et al.
4,012,050 A 3/1977 Miller
4,182,520 A * 1/1980 Stevenson ..... 280/87.042
4,409,287 A 10/1983 Harrison
4,586,451 A 5/1986 Mori
4,719,952 A 1/1988 Geronimo
4,739,723 A 4/1988 Plucknett
4,778,710 A * 10/1988 Deutsch ..... 428/192
5,147,235 A * 9/1992 Bamburak et al. ..... 441/79
5,163,550 A 11/1992 Hawk
5,207,323 A * 5/1993 McConnell ..... 206/315.1
5,664,808 A 9/1997 Whidden et al.
5,967,314 A 10/1999 McGovern
6,012,734 A 1/2000 Skedeleski
6,036,218 A 3/2000 Muff, Jr.
6,059,308 A * 5/2000 Baudin et al. ..... 280/610
D490,491 S * 5/2004 Goa ..... D21/771

FOREIGN PATENT DOCUMENTS

GB 2 404 594 * 9/2005

* cited by examiner

*Primary Examiner*—J. Allen Shriver
*Assistant Examiner*—Bridget Avery
(74) *Attorney, Agent, or Firm*—Hodgson Russ LLP

(57) ABSTRACT

An edge protecting device for snowboards and the like. The device includes an elastic elongate member that is capable of being positioned on the snowboard such that the elongate member covers the edge portions so that first and second reinforcing members align with the toe and heel edge portions, respectively and a strap removably attaches to the elongate member such that the elongate member is held snugly against the side edge portions of the snowboard.

23 Claims, 2 Drawing Sheets

EDGE PROTECTING DEVICE FOR SNOWBOARDS AND THE LIKE

CROSS-REFERENCE TO RELATED APPLICATION

Applicant hereby claims priority based on U.S. Provisional Application No. 60/375,985 filed Apr. 26, 2002, entitled "Edge Protecting Device for Snowboards and the Like" which is incorporated herein by reference.

FIELD OF INVENTION

The present invention relates to protective covers for sporting equipment and more particularly to an edge protecting device suitable for use with snowboards, water skis, wakeboards, trick skis and the like.

BACKGROUND OF THE INVENTION

Snowboards present similar problems to skis with regard to protecting the edges from causing damage or being damaged. This problem is especially significant with regard to the heel and toe portions of the snowboard. The controlling edge of a snowboard is found around the perimeter and if maintained regularly should be machined to a geometry that renders the edge relatively sharp to the touch.

Because this controlling edge is sharp and made of a hard metal, contact with this edge can cause damage to both the snowboard and to the object that contacts the snowboard. When enough damage is sustained by the edge of a snowboard, the snowboard may become difficult to control. At this point, the edge of the snowboard must be "tuned" or remachined back to a sharp geometry.

Accordingly, there is a need for an edge protecting device that prevents the snowboard from causing damage and being damaged by contact with other objects. There is also a need for an edge protecting device that is easy to use and that folds into a small profile when not in use.

SUMMARY OF THE INVENTION

The present invention meets the above-described need by providing an edge protecting device for snowboards and the like. The snowboard includes a flat elongated body having toe and heel edge portions at opposite ends. Opposite side edge portions extend along the body of the snowboard between the toe and heel portions. The edge protecting device includes an elastic elongate member being of a width and length in the relaxed state which is less than the width and length of the snowboard. The elongate member is capable of being stretched in the direction of its width and length to a dimension greater than the width and length of the snowboard. The edge protecting device also includes at least one first rubber-like reinforcing member attached to an inside surface of the elongate member. The edge protecting device also includes at least one second rubber-like reinforcing member attached to an inside surface of the elongate member disposed on the opposite side from the first rubber-like reinforcing member. The edge protecting device also has at least one extended portion disposed along a section of the elongate member where at least one of the reinforcing members is disposed. Also, the edge protecting device includes a strap disposed substantially perpendicular to the elongate member when the elongate member is positioned on the snowboard.

The elastic elongate member is capable of being positioned on the snowboard such that the elongate member covers the edge portions such that the first and second reinforcing members align with the toe and heel edge portions, respectively and the strap removably attaches to the elongate member such that the elongate member is held snugly against the side edge portions.

BRIEF DESCRIPTION OF THE DRAWINGS

The invention is illustrated in the drawings in which like reference characters designate the same or similar parts throughout the figures of which.

DETAILED DESCRIPTION

Figure 1:
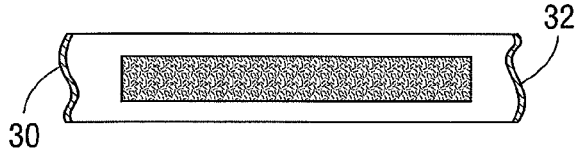
FIG. 1 is a partial perspective view of the elongate member of the present invention.
Figure 3:
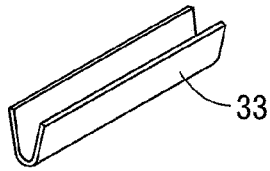
FIG. 3 is perspective view of an insert.
Figure 4:
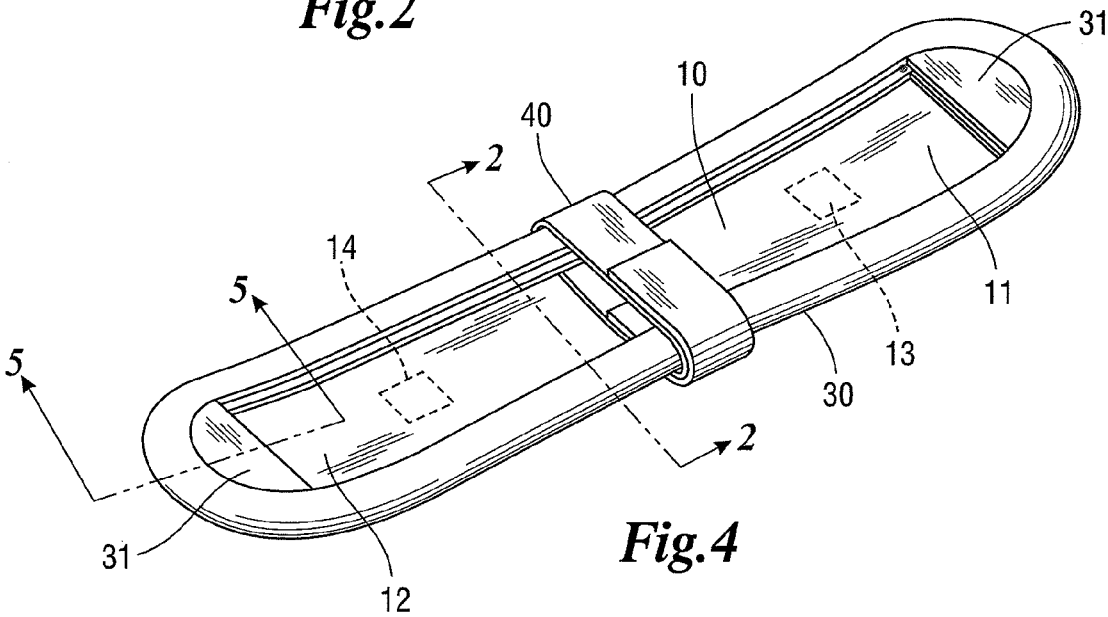
FIG. 4 is a perspective view of the edge protecting device of the present invention mounted on a snowboard.
Figure 5:
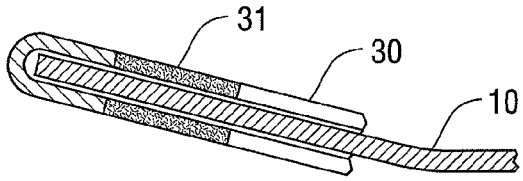
FIG. 5 is a cross-sectional view taken along lines 5-5 of FIG. 4.

Referring to FIGS. 1-5 generally and initially to FIG. 4, an elongate member 30 is made of an elastic rubber-like material. The elongate member 30 may be constructed from a unitary member or may be attached end to end. The material is typically an elastomeric material such as neoprene and may be provided with a cloth-like substrate such as nylon which is attached to the rubber-like elastomeric material. The elongate member 30 has the shape of an oval with a length and width in the relaxed state that is less than the length and width of the snowboard 10. The snowboard 10 is shown in FIG. 4 as transparent for clarity. The elongate member 30 may also be constructed as a composite member with upper and lower elongate flat members attached by an elastic cord. The elongate member 30 may also be formed from an elongate member having an opening with a tacky material on the surfaces of the opening for adhering to the edge of the board 10. An elongate member of this type may have a circular profile or other shaped profile.

In use, the elongate member 30 will stretch around the perimeter of the snowboard 10. The toe and heel portions 11 and 12 typically sustain and cause more damage than the remainder of the perimeter of the snowboard 10. To withstand the impacts to the elongate member 30 when assembled on a snowboard 10, rubber-like reinforcing members 32 are typically glued or sewn into elongate member 30. The reinforcing members 32 are disposed in opposite ends of the elongate member 30 such that they align with the toe and heel portions 11 and 12. The reinforcing members 32 may be constructed of a rubber-like material having a durometer of approximately 40.

Extended portions 31 which may be formed in the shape of a crescent are typically constructed of the same material as the elongate member 30 and are positioned at opposite ends of the snowboard 10. The extended portions 31 are roughly aligned with the ends where the reinforcing members 32 are installed. The extended portions 31 may be sewn or glued into this position. The extended portions 31 provide support at the ends of the snowboard 10 so that the elastic member 30 remains in position at the toe and heel portions 11 and 12 throughout most handling of the snowboard 10. There are typically four extended portions 31 per snowboard 10 with the extended portions 31 being located on the top and bottom at each end.

Figure 2:
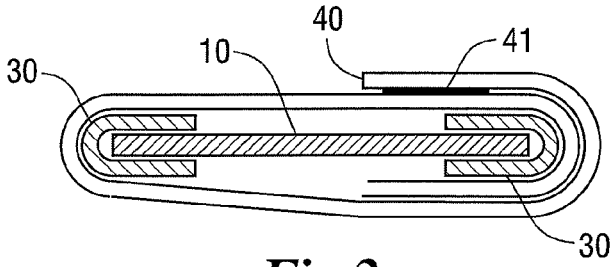
FIG. 2 is a cross-sectional view taken along lines 2-2 of FIG. 4.

A strap 40 best shown in FIG. 2 provides for holding the elongate member 30 in position at a middle portion of the snowboard 10. Because the snowboard 10 is typically provided with an hourglass shape, the elongate member 30 may require additional support in the middle to fit snugly against the edge of the board. If the strap 40 is not used the elongate member 30 may separate from the edge. The strap 40 may be constructed of the same material as the elongate member 30. In FIG. 2, the strap 40 is shown as it would be wrapped around the board 10 and elongate member 30 and secured with hook and loop fasteners. The strap 40 does not have to be permanently attached to the elongate member 30 and may overlap onto itself and be held in position by means of the hook and loop material.

Turning to FIG. 3, an insert 33 is shown. The insert 33 may comprise a plastic material that is preformed or deformable to fit around the edge of a snowboard 10. The insert 33 is intended to be used at the side of the snowboard 10 roughly at the points on the elongate member 30 that would contact the midportion of the snowboard 10. The insert 33 is intended to be affixed to the elongate member 30 to assist, in positioning the elongate member 30 at the midportion of the snowboard 10 where the strap 40 is deployed.

Figure 6:
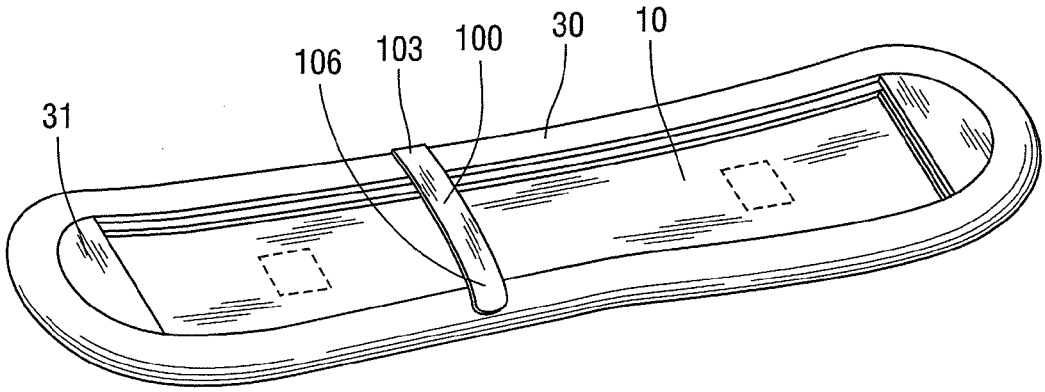
FIG. 6 is a perspective view of an alternate embodiment mounted on a snowboard; and, FIG. 7 is a perspective view of a second alternate embodiment mounted on a snowboard.

Turning to FIG. 6, as an alternate to strap 40, an auxiliary strap 100 may be fixedly attached at a first end 103 to one side of the elongate member 30. At a second distal end 106 the strap 100 is capable of stretching across the board 10 to attach to the other side of the elongate member 30. The distal end 106 may be attached by hook and loop fasteners, buttons, or the like.

Figure 7:
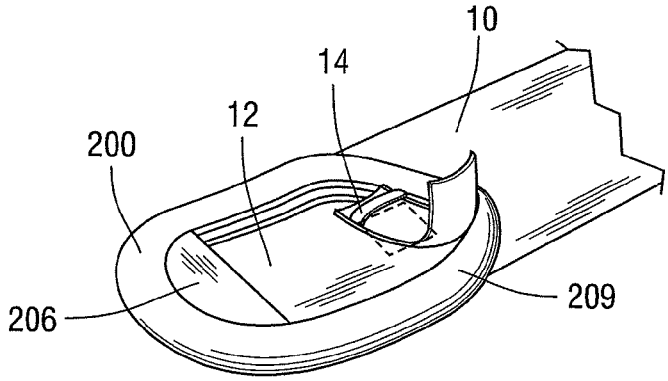

Turning to FIG. 7, in an alternate embodiment an elongate member 200 includes a reinforcing member (not shown) disposed inside the elongate member 200 and having the properties described above in connection with the reinforcing member 32. The elongate member 200 may also be provided with extended portions 206 having the properties of the extended portions 31 described above. The opposite end 209 of the elongate member may comprise a continuous length of the elongate member 200 which is disposed around the binding 14. At the opposite end of the board 10, a second elongate member 200 may be installed in the same manner.

Snowboards 10 come in various widths, lengths, and shapes. The flexibility of the edge protecting device of the present invention is such that it will conform to many different shapes and lengths of snowboards 10. Because there is a limit to the amount of stretch in the material used for the elongate member 30, the device can be made in different lengths to accommodate a wide range of snowboard 10 lengths.

The edge protecting device of the present invention is intended to include other variations such as a two-piece construction for the elongate member 30 that could be joined along its entire circumference or it could be a single piece that attaches end to end. Also, the edge protecting device of the present invention may be provided with a sheet of material that would also cover and protect the bottom of the snowboard 10.

The edge protecting device of the present invention may also be provided with "pockets" that could attach either directly to the ends of the snowboard 10 or the pockets could be held in position by some sort of elastic connector between the opposing ends of the snowboard 10. The pockets would be formed as described above in connection with arrangement of the elongate member 30, reinforcing member 32 and extended portion 31 described above and located at the toe and heel portions 11 and 12 of the board 10. The "pockets" could also be formed of plastic material and attached to one another by elastic cords that may or may not provide edge protection. In this arrangement, the elongate member 200 shown in FIG. 7 would terminate at each side instead of extending around the binding 14. The ends on the opposite sides of the board 10 could be connected to a similar device at the opposite end and connected by elastic cords for tension.

The present invention is also intended to include variations of the previously detailed device using different materials (pure rubber, plastics, cloth materials and knitted materials).

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. An edge protecting device for gliding boards wherein the gliding board includes a flat elongated body having toe and heel edge portions at opposite ends and opposite side edge portions extending along said body between said toe and heel portions, the gliding board having a top and a bottom surface, said device comprising:

a continuous elastic elongate member having opposed ends and being of a width and length in the relaxed state which is less than the width and length of the gliding board, the elongate member capable of being stretched in the direction of its width and length to a dimension greater than the width and length of the snowboard;

a first elastic reinforcing member attached to an inside surface of the elongate member at one end thereof;

a second elastic reinforcing member attached to an inside surface of the elongate member at the other end thereof such that the second elastic reinforcing member is disposed opposite from the first elastic reinforcing member;

at least one extended portion disposed along a section of the elongate member where at least one of the reinforcing members is disposed; and, a strap disposed substantially perpendicular to the elongate member when the elongate member is positioned on the gliding board;

wherein the elastic elongate member is capable of being positioned around the periphery of the gliding board such that the elongate member covers only the edge portions and such that the first and second elastic reinforcing members align with the toe and heel edge portions, respectively and the strap attaches to the elongate member such that the elongate member is held snugly against the side edge portions of the gliding board and wherein the edge protecting device has substantially the same configuration along the side edge portions of the gliding board when the elongate member is installed and wherein the edge protecting device has substantially the same configuration at the toe and heel edge portions when the elastic elongate member is installed and wherein each of the opposed ends of the elongate member is capable of being positioned around either of the heel and toe portions of the gliding board such that edge protecting device is reversible with respect to the toe and heel portions of the gliding board and wherein the edge protection device is reversible with respect to the top and bottom surfaces of the gliding board.

2. The edge protecting device of claim 1, wherein the elongate member is of unitary construction.

3. The edge protecting device of claim 1, wherein the elongate member is connected end-to-end.

4. The edge protecting device of claim 1, wherein the elongate member comprises an elastomeric material.

5. The edge protecting device of claim 1, wherein the elongate member comprises an elastomeric material covered with a fabric substrate.

6. The edge protecting device of claim 1, wherein the elongate member comprises an elastomeric material covered with nylon.

7. The edge protecting device of claim 1, wherein the reinforcing member comprises an elastic material having a durometer of approximately 40.

8. The edge protecting device of claim 1, wherein the extended portion is integrally formed.

9. The edge protecting device of claim 1, wherein the extended portion is attached to the elongate member.

10. The edge protecting device of claim 1, wherein the extended portion is crescent-shaped.

11. An edge protecting device for gliding boards wherein the gliding board includes a flat elongated body having toe and heel edge portions at opposite ends and opposite side edge portions extending along said body between said toe and heel portions, the gliding board having a top and a bottom surface, said device comprising:

a continuous elastic elongate member being of a width and length in the relaxed state which is less than the width and length of the gliding board, the elongate member capable of being stretched in the direction of its width and length to a dimension greater than the width and length of the gliding board, wherein the elongate member is constructed of an elastomeric material with a cloth-like substrate attached thereto;

at least one first elastic reinforcing member attached to an inside surface of the elongate member;

at least one second elastic reinforcing member attached to an inside surface of the elongate member disposed opposite from the first elastic reinforcing member;

at least one extended portion attached to the elongate member along a section of the elongate member where at least one of the reinforcing members is disposed;

a strap disposed substantially perpendicular to the elongate member when the elongate member is positioned on the gliding board; and wherein the elastic elongate member is capable of being positioned around the periphery of gliding board such that the elongate member only covers the edge portions and such that the at least one first elastic reinforcing member aligns with one of the toe and heel portions of the gliding board when the elongate member is positioned around the periphery of gliding board and such that the at least one second elastic reinforcing member aligns with the other of the toe and heel portions of the gliding board when the elongate member is positioned around the periphery of the gliding board, and the strap attaches to the elongate member such that the elongate member is held snugly against the side edge portions and wherein the edge protecting device has substantially the same configuration at the toe and heel edge portions when the elastic elongate member is installed and the edge protecting device is reversible with respect to the toe and heel portions and the top and bottom surfaces of the gliding board.

12. The edge protecting device of claim 11, wherein the elongate member is of unitary construction.

13. The edge protecting device of claim 11, wherein the elongate member is connected end-to-end.

14. The edge protecting device of claim 11, wherein the elongate member comprises an elastomeric material covered with nylon.

15. The edge protecting device of claim 11, wherein the reinforcing member comprises an elastic material having a durometer of approximately 40.

16. The edge protecting device of claim 11, wherein the extended portion is integrally formed.

17. The edge protecting device of claim 11, wherein the extended portion is attached to the elongate member.

18. The edge protecting device of claim 11, wherein the extended portion is crescent-shaped.

19. A method of protecting the edges of a gliding board, the gliding board includes a flat elongated body having top and bottom surfaces and having toe and heel edge portions at opposite ends and opposite side edge portions extending along said body between said toe and heel portions, the gliding board having at least one binding extending from one side, the method comprising:

providing a continuous elastic elongate member being of a width and length in the relaxed state which is less than the width and length of the gliding board, the elongate member capable of being stretched in the direction of its width and length to a dimension greater than the width and length of the gliding board; at least one first elastic reinforcing member attached to an inside surface of the elongate member; at least one second elastic reinforcing member attached to an inside surface of the elongate member disposed opposite from the first elastic reinforcing member; at least one extended portion disposed along a section of the elongate member where at least one of the reinforcing members is disposed; a strap disposed substantially perpendicular to the elongate member when the elongate member is positioned on the gliding board; wherein the elastic elongate member is capable of being positioned on the gliding board such that the elongate member covers the edge portions and wherein either of the first and second reinforcing members is alignable with either of the toe and heel edge portions of the gliding board, respectively and the strap attaches to the elongate member such that the elongate member is held snugly against the side edge portions;

positioning the elongate member over one of the heel and toe edge portions the first reinforcing member engages with one of the heel and toe edge portions;

stretching the elongate member to position the opposite end of the elongate member over the remaining one of the heel and toe edge portions such that the second reinforcing member engages with the remaining one of the heel and toe edge portions;

wrapping the strap around a midportion of the elongate member such that the elongate member is held snugly against the side edge portions of the gliding board; and, wherein the edge protecting device has substantially the same configuration at the toe and heel edge portions when the elastic elongate member is installed whereby the edge protection device is reversible with respect to the toe and heel portions and the top and bottom surfaces of the gliding board.

20. The method of claim 19, wherein the elongate member comprises an elastomeric material having a fabric substrate attached thereto.

21. The method of claim 19, wherein the elongate member has a unitary construction.

22. An edge protecting device for gliding boards wherein the gliding board includes a flat elongated body having toe and heel edge portions at opposite ends and opposed top an bottom surfaces, a pair of bindings extending from the flat elongate body top surface, and opposite side edge portions extending along said body between said toe and heel portions, said device comprising:

an elastic elongate member having a profile that defines an opening and the elastic elongate member arranged to fit over one of the heel and toe portions and over the binding located nearest to the one of the heel and toe portion where the elongate member is attached and the binding located nearest to the one of the heel and toe portions where the elongate member is attached is exposed through the opening after the elastic elongate member is arranged to fit over the one of the heel and toe portions; and wherein the elastic elongate member is positioned on the gliding board such that the elongate member covers the edge portion on the one of the heel and toe portions where it is installed, and the toe and heel portions of the elongate member each having an elastic reinforcing member and the elongate member is reversible with respect to the top the top and bottom surfaces of the gliding board without contacting the bindings and further wherein the elongate member is reversible with respect to the toe and heel portions of the gliding board.

23. An edge protecting device for protecting an object having opposed heel and toe portions and opposed surfaces, opposed side edge portions, a width, length and periphery, the edge protecting device comprising:

a continuous elastic elongate member being of a width and length in the relaxed state which is less than the width and length of the object, the elongate member capable of being stretched in the direction of its width and length to a dimension greater than the width and length of the object;

at least one first elastic reinforcing member attached to an inside surface of the elongate member;

at least one second elastic reinforcing member attached to an inside surface of the elongate member and disposed opposite from the first elastic reinforcing member and wherein the at least one first elastic reinforcing member is capable of being installed on either of the heel and toe portions of the object and the at least one second elastic reinforcing member capable of being installed on either of the heel and toe portions of the object;

at least one extended portion disposed along a section of the elongate member where at least one of the reinforcing members is disposed; and, a strap disposed substantially perpendicular to the elongate member when the elongate member is positioned on the object;

wherein the elastic elongate member is capable of being positioned around the periphery of the object such that the elongate member covers only the edge portions thereof and the strap attaches to the elongate member such that the elongate member is held snugly against the side edge portions of the object and wherein the elongate member is capable of being positioned on the periphery of object such that the elongate member is reversible with respect to the opposed heel and toe portions of the object and is reversible with respect to the opposed surfaces of the object.

* * * * *